United States Patent [19]

Malcolm

[11] 4,091,482

[45] May 30, 1978

[54] INFLATABLE SLEEPING BAG

[75] Inventor: Richard Malcolm, Oakville, Canada

[73] Assignee: Her Majesty the Queen in right of Canada, as represented by the Minister of National Defence, Ottawa, Canada

[21] Appl. No.: 657,645

[22] Filed: Feb. 12, 1976

[30] Foreign Application Priority Data

Feb. 12, 1975 United Kingdom ..... 05879/75

[51] Int. Cl.[2] ..... A47G 9/00

[52] U.S. Cl. ..... 5/343; 5/355; 5/361 R; 428/328; 5/344

[58] Field of Search ..... 428/389, 93.1, 222, 428/283, 328, 458; 156/183; 264/167, 178; 427/209; 5/343, 355, 361, 361 B

[56] References Cited

U.S. PATENT DOCUMENTS

| | | | |
|---|---|---|---|
| 2,379,416 | 7/1945 | Clark | 5/343 X |
| 2,620,493 | 12/1952 | Brelsford | 5/367 |
| 3,038,234 | 6/1962 | Scheyer | 428/389 X |
| 3,395,066 | 7/1968 | Tucker | 5/361 R X |
| 3,831,206 | 8/1974 | Geary | 5/343 |
| 3,967,010 | 6/1976 | Maekawa | 428/389 |

FOREIGN PATENT DOCUMENTS

| | | | |
|---|---|---|---|
| 207,621 | 11/1939 | Switzerland | 5/343 |
| 648,452 | 1/1951 | United Kingdom | 5/343 |

*Primary Examiner*—Casmir A. Nunberg

[57] ABSTRACT

A mat having layers of impermeable material adapted to inflation as an air-mattress, inflatable blanket or component of a sleeping bag, and containing an insulating amount of a lofting shredded matallized plastic web, and having a valve means for inflation and deflation of the mat. The insulating plastic web may comprise a plurality of webs of metallized plastic film, said webs having at least sections thereof in strip form, oriented randomly in non-planar configurations. The impermeable material is made from plasticized material such as urethane coated nylon fabric or plastic coated cotton fabric.

20 Claims, 14 Drawing Figures

INFLATABLE SLEEPING BAG

PRIOR ART

With reference to the improvement by this invention, and in the discussion which follows, attention is directed to the following prior art.

(1) "Insulated Air Mattress", H. W. Brelsford, Canadian Pat. No. 491,444, Mar. 24, 1953.

(2) "Self-Inflatable Air Mattress and Sleeping-Bag", C. J. Gaiser, Canadian Pat. No. 958,493, Nov. 23, 1974.

(3) "Heat-Retaining Article of Manufacture", J. Chapuis, Canadian Pat. No. 866,094, Mar. 16, 1971.

(4) "Mattress And Sleeping Bag", P. M. Vilas, U.S. Pat. No. 1,648,373, Nov. 8, 1927.

(5) "Self Inflatable Air Mattress, And Sleeping Bag With Air Pressure Control", C. J. Gaiser, U.S. Pat. No. 3,877,092, Apr. 15, 1975.

(6) "Sleeping Bag", P. A. A. Merikallio, U.S. Pat. No. 3,750,202, Aug. 7, 1973.

(7) "Sleeping Bag Made Of Paper", J. W. Nicholson, U.S. Pat. No. 2,625,695, Jan. 20, 1953.

(8) "Cushioning Dunnage Product", G. R. Johnson, U.S. Pat. No. 3,650,877, Mar. 21, 1972, and (9) "Resilient Cushion", Helmut Werner et al, U.S. Pat. No. 3,852,152, Dec. 3, 1974.

This invention relates in one aspect to an inflatable sleeping-bag which is also useful as a casualty bag, the lower portion of the bag being separately inflatable from the upper portion so that it can act as its own mattress, the two portions of the bag being held together by a quick-fastening device.

A major advantage of this sleeping-bag is that the insulation properties of the bag may be controlled by the occupant according to the temperature demands of his environment, by varying the amount of air in the upper portion of the bag, using the small bellows provided.

SUMMARY AND OBJECTS

Briefly, there are three main facets to this invention:

(a) its use as a much-improved sleeping-bag;

(b) its use as an improved air-mattress;

(c) a significant contributing factor to both (a) and (b) above: the use of aluminized "MYLAR" (Trade Mark), as an insulator in replacing the polyester and down insulating material traditionally used for their lofting properties in conventional sleeping-bags.

The current sleeping-bag, as used by the Canadian Armed Forces, and other Government Agencies, to some extent, fulfils a need in that such bags should be flexible enough to be useful in climates of great variance, and be sufficiently portable for easy carriage.

These prior art systems consist of essentially three bags, one flannel, and two down-filled, which can be used separately, or stuffed, one inside the other for increased thermal protection. The bag, and its occupants, are then supported on an inflatable rubber mattress.

There are several disadvantages to this system:

Should the down get wet, it loses most of its insulating properties, and requires some time to dry sufficiently to provide the required protection. Also, down is subject to rotting, and bio-degradation, once it becomes wet; hence it has a comparatively short useful lifetime.

The previous system requires the use of multiple zippers and drawstrings, making entry and exit quite difficult, especially if the hands are affected by cold, or encumbered by mittens or gloves.

As a compromise against weight, the previous bag is designed with only sufficient thermal insulation to keep the occupant from becoming unmanageably cold after a set length of time at a particular range of temperature; for instance, 8 hours at −30° to −40° F.

This is usually tolerable, as the later intake of a hot meal, and moving about, by the occupant, is sufficient to restore body comfort. However, if the occupant is immobile; for instance, through injury, then this extra procedure could be very difficult, or impossible, in extreme cases to follow. Besides the relative lack of thermal insulation, the previous sleeping-bag makes it difficult to gain access to any person in this predicament, short of complete removal from the bag. In addition, the weight of the occupant on the down in the bottom half of the present bag, compresses the down so that it has little more insulating properties than a wool blanket, as has been shown by the prior art, as shown in Canadian Pat. No. 491,444 above.

This disadvantageous effect is combined with the problem that the air-spaces in the mattress are sufficiently large to allow convective cooling, and hence reduce thermal protection.

The new invention is helpful in solving the above problems, by virtue of a combination of some, or all, of the following features.

The present invention therefor provides a heat insulating material comprising a plurality of webs of metallized plastic film, said webs having at least sections thereof in strip form, oriented randomly in non-planar configurations.

In another aspect the present invention provides a mat having layers of impermeable material adapted to inflation as an air-mattress, inflatable blanket or component of a sleeping bag, and containing an insulating amount of a lofting shredded metallized plastic web and having a valve means for inflation and deflation of the mat. Such a mat may be incorporated into an inflatable sleeping bag, said bag having an inflatable upper portion and an inflatable lower portion, the lower portion of the said bag being separately inflatable from the upper portion, the portions of the said bag being closeable with a fastening means, each of the portions being provided with an insulating amount of the lofting shredded metallized plastic web.

The invention, in another aspect, provides a mat having layers of impermeable material adapted to inflation as an air-mattress, inflatable blanket or component of a sleeping bag, and containing an insulating amount of a lofting shredded metallized film of plastics material, and having a valve means for inflation and deflation.

The mat is preferably adapted to be used as an inflatable sleeping-bag, having an inflatable upper portion and an inflatable lower portion, the lower portion of the said bag being separately inflatable from the upper portion, the portions of the said bag being closable with a fastening means, each of the portions being provided with an insulating amount of a lofting shredded metallized plastic-film.

The arrangement may be such that the occupant can select the personally-desired amount of insulation according to the ambient temperature by varying the amount of air in the upper portions of the mat.

In another aspect this invention provides a mat having layers of impermeable material adapted to inflation as an air-mattress, inflatable blanket or component of a sleeping bag, and containing an insulating amount of a lofting shredded resilient plastic web formed of plastic film, said web having at least sections thereof in strip form, oriented randomly in nonplanar configurations, and having a valve means for inflation and deflation of the mat. Such a mat may be incorporated into an inflatable sleeping bag, said bag having an inflatable upper portion and an inflatable lower portion, the lower portion of the said bag being separately inflatable from the upper portion, the portions of the said bag being closeable with a fastening means, each of the portions being provided with an insulating amount of the lofting shredded plastic web. The insulating material will normally comprise a plurality of strips of resilient plastic film oriented randomly in non-planar configurations.

As to the material for the shredded plastic film we experimented with several films. Paper is known in the art as a material for use in certain applications with are superficially similar to the present invention. Generally however paper does not have sufficient lofting properties to render it a viable material. Paper can be used as a heat insulating material, but in any application where it must be repeatedly crushed and lofted again it will not be found to be as useful as the resilient plastic material disclosed in the present invention. The present material made of plastic film will tend to retain its original shape, or to retain a folded or creased configuration once formed.

It should be possible to take advantage of the so called "memory" of thermoplastic material. For example it should be useful to form the plastic film in a bulked folded condition, which would tend to give the resulting random excelsior material even greater resistance to crushing. This does not appear to be essential since in the case of ribbons and strips the material is not able to return completely to a flat condition since these strips are tangled and randomly distributed in the insulating layer.

Referring to the sleeping bag filling material again, we have found that Mylar has excellent recovery after crushing. Its recovery is faster than that of down fill and it appears to be able to make this recovery an unlimited number of times. It does make a slight crackling noise as it is crushed and when it is recovering. This noise is less or absent from other filler materials such as nylon and polyvinyl chloride, but these more silent materials have less recovery efficiency. The Mylar or other plastic will generally be about 0.5 to 2 mil. thick. A thickness of 0.7 to 1.3 is preferred, and Mylar of 1 mil. has been found especially suitable.

In constructing a sleeping bag the material for the impermeable layers may be a standard dingy or plasticized coated rip-stop nylon such as urethane coated material. Other materials such as cotton drill which has been coated with plastic may also be useable. The material must be capable of holding a positive air pressure for a suitable length of time such as 8 to 10 hours. The interior webbing forming partitions in the center of the mat in a sleeping bag should be made of something light and strong. Its sole purpose is to keep the filling material from shifting about in the leg. We have found that very fine nylon material is suitable for this. It need not be impermeable and thus is not coated.

In the drawings which accompany this specification:

DISCUSSION OF THE INVENTION

Figure 1:
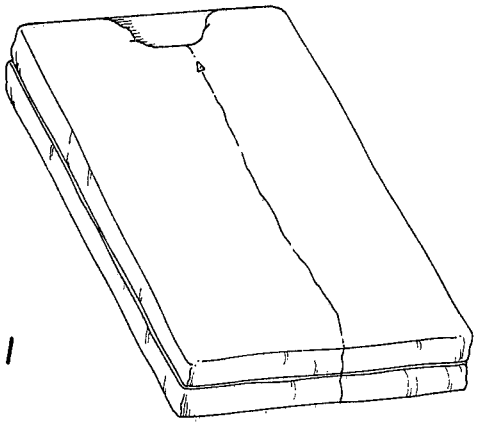
FIG. 1 is an isometric view of a sleeping bag.

By the use of this invention a sleeping bag can be obtained which is inflatable so that the subject or user has a bag capable of providing thermal protection over a very wide range of ambient temperatures, such as from −40° F. to around 60° F. The reason for having it inflatable would be that by altering the air pressure within the bag the loft or insulation provided by the bag could be varied to suit the requirements of the user. The concept of inflatability was also tied into whether a person could sleep in a bag which was vapour impermeable.

Since the material is vapour impermeable any sweat which a person creates could cause a problem.

Preliminary tests showed that in fact this sweat would be disposed of and therefore a vapour impermeable bag was suitable for containing a human being. We then built a bag which was inflatable in the manner of a rubber mattress but which was designed for use to completely surround the individual. Then we were faced with the problem what would fill the dead air space within the inflated portion of the bag as an insulating material to prevent convection currents from occurring and taking the heat away from the body. The obvious choice was a material such as down or some other standard filler materials. However when one uses down one has first of all to contend with its bio-degradeability and second of all to contain the down within the bag even while you are trying to deflate it. The problem is that the down will escape through the valve mechanism out into the air and be lost. Thus, we use strips of plastic to approximate a tangle of something like steel wool. As the strips of plastic can be pushed inside the bag, it provides a very good lofting material, to fill the space while the bag was inflated and yet because it was foldable or crumplable, the material could be compressed when the bag is stored. We experimented with different types of clear plastic materials such as Mylar, polyvinyl chloride and polyurethane and found that these were suitable.

Research work by Berton during the Second World War, indicated that roughly 25% of the heat lost by a body when exposed to the cold is lost by radiation rather then by convection currents. This led us to experiment with provision of a radiation barrier as well as the convection barrier offered by the filler material we have been contemplating. The best way to provide a radiation barrier in the filler materials was to have it coated with a very thin film of metal such as aluminum.

Thin aluminized plastic film was cut into strips and tested as a suitable filler. We tested many different configurations for this filler material. Among parameters investigated were the width of the strips, and the difference between coating the material with aluminium on only one side or on both sides, as well as the difference effected by crimping the webs as opposed to not crimping them. The material for the web may be chosen from any resilient stiff sheet material, generally thermoplastic materials.

The lofting material, in one aspect, consists of a tangled mass of strips forming a myriad of interstitial spaces, thus minimizing heat transfer by convection currents. Since the preferred sheet material is essentially a low heat conducting material there is relatively little heat loss through conduction. By coating the metal film with a very shiny aluminum surface we reduce to a minimum any radiant heat loss. Since we found that the Mylar material was substantially opaque to infrared radiation, this meant that coating only one side of the material with aluminum left the other side substantially "black" and permitted some radiant heat transfer. By coating both sides of the sheet we minimimized the radiant heat loss still further.

The inflatable sections are made to be convenient to inflate to a desired thickness, to provide comfort in the form of an air mattress, and to provide a desired level of heat insulation above the user. The lofting excelsior expands to fill the inflated space. By selecting the correct amount of insulation by inflating or deflating the top section of the inflatable sleeping bag a reduction in sweating can be obtained, to the extent that there is little or no discomfort from accumulation of fluid inside the sleeping bag. Any discomfort can be reduced still further or eliminated entirely by the use of a suitable liner, particularly beneath the user of the bag. This should desirably be made of wool or some other fabric which is relatively comfortable when damp. By making the inflatable sections of the bag impervous this precludes degradation of the filler in the bag by moisture penetration. Such moisture can be introduced in ordinary prior art sleeping bags by rain, falling in the water during canoeing or the like, or sweat penetration. Even in the absence of such overt sources of water prior art sleeping bag having impermeable covering may become damp in very cold weather by a phenomenom known as frost creep. This is formation of frost by condensation at the point where the heat provided by the user in the bag levels off to the point where condensation can occur at a point within the covering of the sleeping bag.

In a preferred embodiment, it is constructed of a rubberized, or plasticized, fabric, which is constructed so as to be inflatable, (i.e. the seams are air-tight), and a small bellows is provided for inflation and deflation. The arrangement of this fabric is in a similar pattern to the prior down-filled bag, with the occupant surrounded by an inner layer, while the outer layer is exposed to the environment. The lower portion of the bag is separately inflatable from the upper portion, so that it can act as its own mattress. The portions of the bag are held together with VELCRO (Trade Mark), or some other quick-fastening device.

Very importantly, the down-fill is replaced by an excelsior made from metallized plastic film, for example, aluminized "MYLAR" (Trade Mark), as disclosed in Canadian Pat. No. 727,574.

This excelsior expands to fill the space inside the inflated segments of the bag. The use of "MYLAR" (Trade Mark) excelsior is an improvement on the prior art, such as an insulation material.

The strips of fill are sufficiently narrow, ($\frac{1}{8}$ to 1 inch wide), that the tangled mass will greatly reduce convection currents which result in loss of heat between the layers of fabric.

The metallized surfaces of the plastic film provide an effective radiation barrier to further insulate the occupant, the effect is shown in the prior art, as in Canadian Pat. No. 903,585.

The plastic film is itself practically a non-conductor of heat, and thus very little heat is lost by conduction.

The occupant can select the desired amount of insulation that is personally required, by varying the amount of air in the upper portions of the bag.

If the bellows are used in reverse, to deflate the section flat, the insulation can be reduced to that of a blanket. This process also makes storage and packing easier.

The materials from which the bag is constructed, are cheap and readily available, and construction techniques have already been formulated for commercially-available air-mattresses.

The sleeping-bag provides better protection, is lighter in weight, and has a greatly-improved life expectancy, as compared with existing sleeping bags.

There are the following main aspects to this concept:

1. Because the bag is inflatable, the occupant can select the thermal insulation that he personally requires for comfort, in a given environment.

2. It seems that the metallized-plastic film excelsior "MYLAR" (Trade Mark), is a superior filling material in this type of application, than the down traditionally used, because it is not susceptible to wetting, and has thus a much-improved life expectancy.

The present invention, therefore, provides in one aspect a mat having two layers of impermeable material adapted to inflation as an air-mattress, inflatable blanket or component of a sleeping-bag, and containing an insulating amount of a lofting shredded metallized film of plastics material, and having a valve means for inflation and deflation.

Turning to the sleeping bag itself, the basic concept comprises a underlying air mattress and an overlying inflatable blanket which are peripherally joined together. The inflatable panels are of course impervious and do not have the advantage of pervious existing sleeping bags of allowing moisture and sweat to dissipate. However, in the normal course of events an individual who finds himself uncomfortably damp from sweat can merely deflate one or both of the panels to the point where the bag is no longer too warm for the ambient temperature conditions, at which point, in principal at least, the sweating should greatly reduce or cease. A person may find it necessary or desirable to make adjustments during the nights sleep one or more times depending on changes in the weather and on his own metabolism. This provides capability for varying the warming effect of the sleeping bag to avoid the accumulation of sweat. It is also of course valuable in that it enables a camper or other person to use a single sleeping bag for a very wide range of ambient temperatures.

Referring again to the question of the sweat retention by the impermeable inflatable material, it will be helpful for many individuals to wear pyjamas or underwear in order to avoid possible discomfort from sleeping on an impermeable surface. If the individual is still bothered by this phenomenon, it is advisable to incorporate a liner between the individual and the bag. Such a liner should of course be attached at several points to the bag so that it does not interfer with the freedom of movement of the individual in the bag. Wool is preferred.

The main objects of the invention are shown in the above-detailed description and in the following drawings, based on those details.

FIG. 1 is an isometric view of the two portions of the sleeping-bag, shown in the inflated condition, with the two portions being joined by a quick fastening device e.g. "VELCRO" (Trade Mark).

Figure 2:
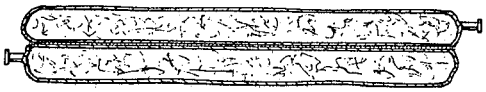
FIG. 2 is a cross-section of the bag of FIG. 1.

FIG. 2 is a length-wise cut away section of the sleeping-bag, again shown in an inflated condition and with the two sections joined with the quick-fastening device. This view shows the expanded excelsior of metallized plastic strips used as internal insulating material in the portions of the bag. The outer surface of the sleeping bag being constructed of a light-weight inflatable rubberized plastic dinghy material.

Figure 3:
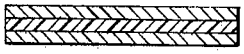
FIG. 3 is a cross-section of the metallized-plastic insulating material.

FIG. 3 is a cross-section of the metallized plastic insulating material (e.g. aluminized "MYLAR" (Trade Mark)), not to scale, with the plastic film between two outer metallized surfaces. As is known in the art, the film of aluminum or other metal will normally be about 1 or 2 microns thick.

This is, naturally, a greatly magnified view as the thickness of the insulating material is virtually approaching that of light-weight foil, i.e. is extremely light.

Figure 5:
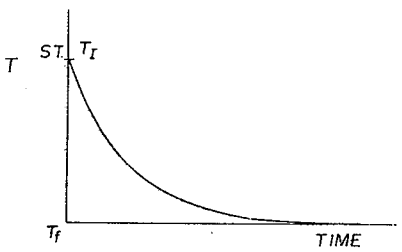
FIG. 5 is a graph showing the asymptotic behaviour of the insulation in such a test device.
Figure 4:
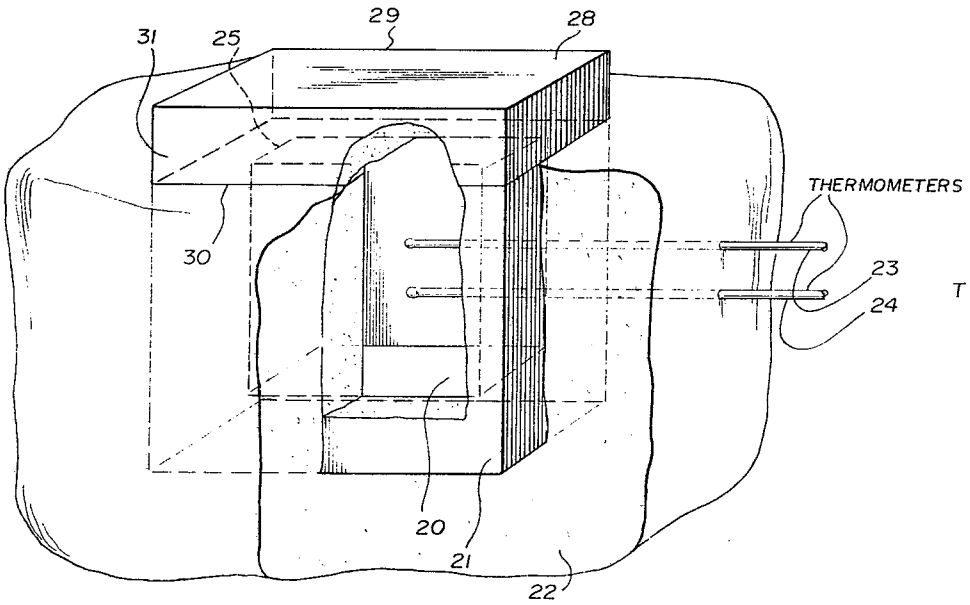
FIG. 4 shows semi-schematically an apparatus for testing the heat retention provided by the present invention.

We used a known test procedure for testing the efficiency as an insulating material. The experiment is sometimes known as a "Standard Newtons Cooling Experiment", wherein a given quantity of water is raised to an initial temperature in a bath. The bath is surrounded on all four sides and on the bottom by a material having very good heat transfer resistance. The top of the cubic bath is then made up entirely of a sample material to be tested. Referring to FIG. 4 a water containing bath 20 is contained in a heat insulating block of polystyrene foam material 21. The whole assembly is contained in a further insulating layer 22 surrounding the sides and bottom of the insulating container 21. The insulating layer 22 which is known in FIG. 4 was made from a regular prior art sleeping bag in our test procedure. Suitably placed thermometers 23 and 24 enable accurate readings of the temperature of the bath 20 at various levels therein. Closing the top of the bath 20 and extending far enough beyond the edge 25 of the bath 20 so far as to minimize or avoid entirely edge effects is a test specimen 28 consisting of an upper layer 29 and a lower layer 30 of thin impermeable material. Between the layers 29 and 30 there is insulating material 31 (not shown). Water is placed in bath 20 and set at a given temperature $T_i$ (initial temperature) as shown in FIG. 5. The whole test unit is placed in a room having a low ambient temperature $T_f$ (final temperature). When the temperature of the bath is plotted against time it will be seen that the temperature of the bath drops relatively rapidly at first, then levels out as the temperature differential $(T-T_f)$ is reduced. The cooling takes place along an exponential path and very slowly approaches the final temperature $T_f$ for a discussion of the considerations involved in these measurements we would refer to the book entitled "Response to Physical Systems" J. D. Trimmer — John Wiley and Sons Incorporated, N.Y., Chapman & Hall, London (1950), the contents of which are hereby incorporated by reference.

In order to obtain a more directly meaningful comparison between various test results we employ a logarithmic function, so that the exponential curve is converted into a straight line. Thus, if the function $$\ln [T-F_f/Ti-T_f]$$

is plotted against time, the exponential curve of FIG. 5 will be seen as a straight line, of negative slope, which slope will be proportional to the insulating efficiency of the sample being tested.

Figure 6:
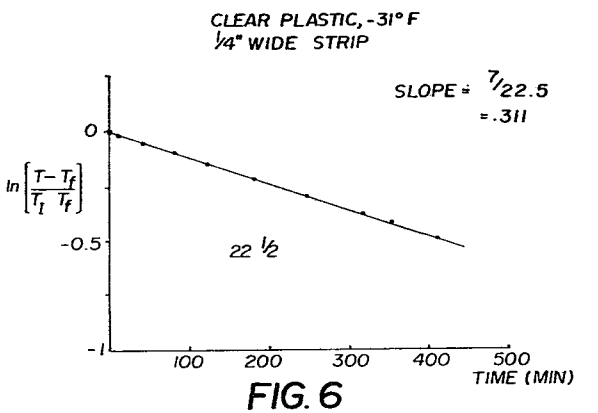
FIGS. 6–9 show logarithmically the behaviour of various embodiments of this invention under test.

The natural log of T (representing the instanteous temperature of the water) $-T_f$ (which is the final temperature or the room temperature) divided $T_f$ (which is the initial temperature or the starting temperature of the water). That function versus time is a linear function and as such shows whether the experiment is "clean" or not, namely whether edge effects or possibly some warming or other effects of the insulating material and so forth are contributing to the result. If the plots turn out to be straight lines then this indicates that the experiment is not suffering from any side effects or abnormalities. FIG. 6 shows the results of one of these plots wherein is plotted the results of a clear plastic material in a room temperature $T_f$ of $-31°$ F. and this log function is plotted against time. It can be seen that the line is a straight line indicating that it is a clean experiment and the slope of that line is 0.311.

Figure 7:
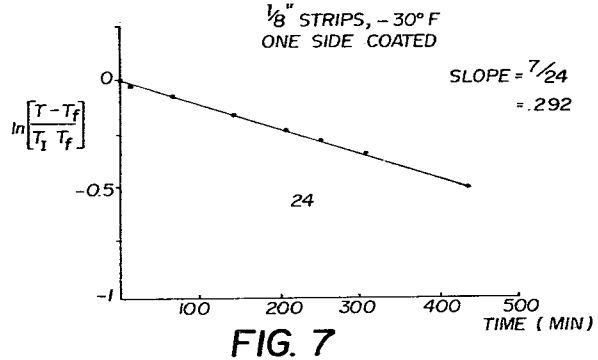

FIG. 7 shows the results of such an experiment on ⅛ inch strips, one side of which was coated, and the slope of that line is 0.292, some 8% more efficient than the clear plastic. The clear plastic was in strips one quarter inch wide.

Figure 8:
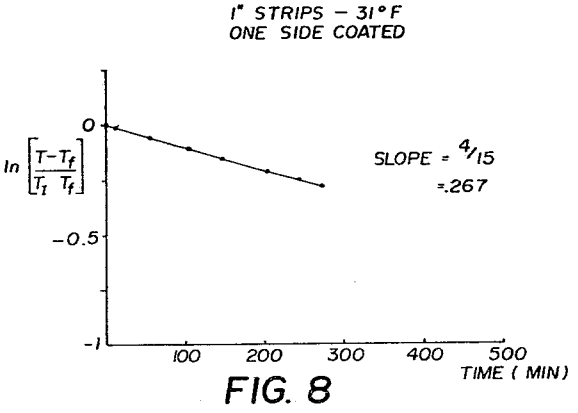

FIG. 8 shows the results of this cooling experiment done with strips one inch wide, again one side of which is coated. The slope is 0.267. This is some 10% more efficient then was the ⅛ inch strips.

In practice one would expect that this means that a given amount of this insulating material would delay the cooling or heating of an object by 10% or alternatively you could have equivalent time of heating or cooling with a smaller amount of insulating material.

As an example of trying to keep something cool it may well be useful to have a portable collapsible refrigerator unit, for instance where some means of providing heat transfer out of a closed space could be carried in along with an inflatable refrigerating container into jungle areas or something along those lines.

Figure 9:
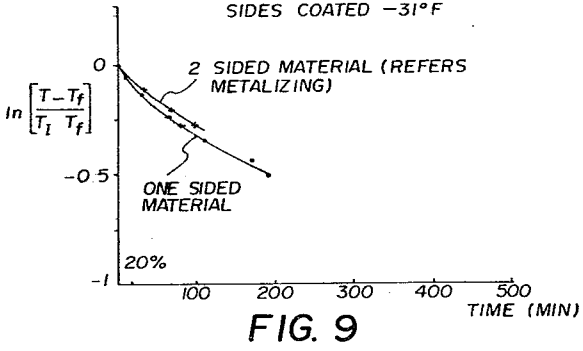

FIG. 9 is an experiment done with a smaller sample due to not being able to get enough of the relevant material, wherein an attempt was made to compare the efficiencies of ¼ inch wide strips having respectively one side coated, and two sides coated. The new cooling curves are no longer straight lines illustrating the edge effects due to having a smaller sample but they are sufficient to show that the two-sided material is some 20% more efficient than the one-sided material.

Figure 10:
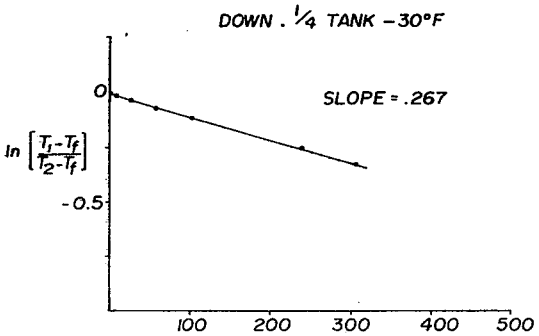
FIG. 10 shows logarithmically the behaviour of the prior art down material.

FIG. 10 shows the results of a cooling curve experiment on goose down, in the apparatus shown in FIG. 4. The slope of the line is 0.267, shown that it has the same insulating efficiency as the 1 inch strips of Mylar coated on only one side.

In order to test the insulating material under real conditions, with a living subject, a human volunteer was used in a cold chamber. The volunteer was placed in a commercially available, down filled bag (Woods, Mount Whitney (Trade Mark), and temperature sensors located at six different points on the body were used to establish at what ambient temperature the subject in the bag came to thermal equilibrium.

The same subject was then placed in a similar bag, in which the down filling had been removed and replaced with the excelsior of ⅜ inch wide strips of 0.5 mil mylar, aluminized on one side only. The bags were weighed and the original down filled bag was found to be 15% lighter. With the subject in the experimental bag, it was discovered that the equilibrium temperature was comparable to the control value within the limits of measurement. The experiments were repeated for reproducability, but it must be pointed out that this type of experiment is in no way as accurate as the physical testing reported above, and merely serves to indicate that the physical testing is relevant to the biological case.

Figure 11:
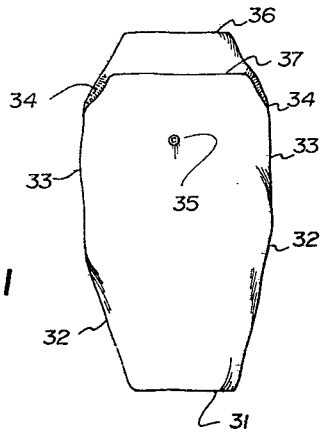
FIG. 11 shows in plan view a sleeping bag made in accordance with this invention.

FIG. 11 shows in plan view a typical sleeping bag made in accordance with this invention.

The bottom 31 the lower part of the size edges 32 and the mid portions of the side edges 33 are permanently closed in this embodiment. The upper portion of the side 34 are open, and may be closed during use by a suitable closure device, such as VELCRO (Trade Mark). A valve 35 is provided at a position handy to the user of the bag. This valve 35 is for inflating the top of the sleeping bag. A similar valve is provided at a convenient point for inflation of the bottom part of the bag. The top portion 36 of the bottom of the bag extends beyond the top portion 37 of the top of the bag, to provide a head rest. Head rest portion 36 may be provided with any convenient finishing device, such as a hood, or other type of head or shoulder cover, which may conveniently co-operate with portion 37 of the top of the bag. In the embodiments showing in FIG. 11 the inside diameter of the bag between side walls 33, 33 was 40 inches. The length of the foot portion 31 was 24 inches, as was the head portion 36. The distance from portion 36 to portion 37 was 8 inches, and the distance from portion 36 to the bottom of the VELCRO attachment points of portions 34 was 18 inches. The side panels 33 were 36 inches long and the side panels 32 were 24 inches long.

Figure 12:
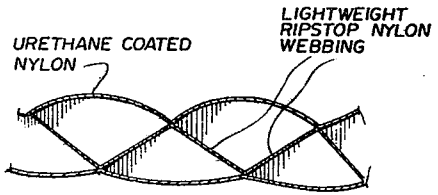
FIGS. 12, 13 and 14 show in cross-section details of various sections of a typical sleeping bag such as shown in FIG. 11.
Figure 13:
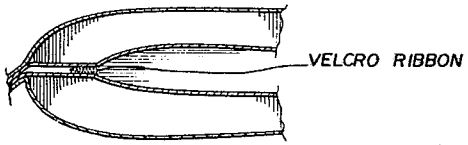
Figure 14:
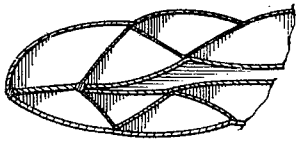

FIG. 12 shows a partial section through a typical portion of the upper or lower sleeping bag panels. FIG. 13 show the partial section of a side seam of the bag. FIG. 14 shows a partial section of a bottom seam on the foot portions 31 of the bag.

The valve as is shown in FIG. 11 is located on the upper most surface of the top half of the bag about the level of the user's chest so that it should be available if the pressure within the top half of the bag is to be alterated. The tubes or panels which go into making up the bottom and top halves of the bag are made in conformity with standard sleeping bag technology. There are many different ways of doing this and the choice of which way will simply be according to however the manufacturer sees fit or whatever equipment he has on hand suitable for manufacturing the bag. In FIG. 11 the bag is of a tapered design. A large distance 33 to 33 is necessitated since the bag when inflated, is relatively rigid. Should the user wish to lie on his or her side, the knees must be drawn up towards the chest and there must be sufficient room to accommodate the length from the hip to the outer side edge of the knee without distorting the bag. The edges that must be joined have to be joined in such a fashion that a considerable overlap, of the order of three to four inches, exists where insulating material is interposed between the user and the outside environment. This avoids a line or area where insufficient insulation would exist.

In the embodiments which will be used as a casualty bag there will be access by means of Velcro secure openings put at strategic points throughout the bag so that a casualty need not be removed in any way from the bag in order to work on his wounds or in other ways have access to the individual. The present system is such that in order to get at any point other than the head of the user, he must be extricated entirely from the bag. These openings or access points will be secured by something like Velcro or a suitable zipper.

A means exist whereby an user of the bag shall be prevented from putting his head into the bag. It consists of a sheet, fixed to the upper most portion 37 of the top of the bag, the head end such that the sheet can extend around over top of the head and is provided with a slot in it for the wearer to put his head through. This then leaves the head out and the remaining portion of the sheet is tucked under beneath the shoulders and provides a barrier preventing the individual from pulling the head into the bag. It also prevents cold air from disturbing the shoulder area and neck area of the wearer. The head gear normally worn outside should be continued to be worn while using the bag in very cold climates.

I claim:

1. A mat comprising plural layers of impermeable material joined at the peripheral edges thereof to permit inflation as an air-mattress, inflatable blanket or component of a sleeping bag, containing an insulating amount of a tangle of lofting heat insulating material formed of shredded metallized plastic film having at least sections thereof in elongated strip form and oriented randomly in non-planar configurations, and valve means in one of said layers of impermeable material for inflation and deflation of the mat.

2. An inflatable sleeping bag formed by a pair of superposed mats, each mat comprising a plural layers of impermeable material joined at the peripheral edges thereof to permit inflation and containing an insulating amount of a lofting heat insulating material formed of shredded metallized plastic web having at least sections thereof in strip form and oriented randomly in non-planar configurations, and valve means in one of said layers of impermeable material for inflation and deflation of the mat;

said mats forming an inflatable upper portion and an inflatable lower portion, respectively, the lower portion of the said bag being separately inflatable from the upper portion, the portions of the said bag being closeable with a fastening means, each of the portions being provided with an insulating amount of the lofting shredded metallized plastic web.

3. A sleeping bag as defined in claim 2 including means for selecting the personally-desired amount of insulation provided by said upper portion according to the ambient temperature comprising said valve means for varying the amount of air in the upper portion of the sleeping bag.

4. An inflatable sleeping bag as in claim 2 wherein said fastening means is a zipper or a "Velcro" fastener.

5. An inflatable sleeping bag as in claim 2 wherein said sleeping bag comprises a web secured with the upper portion adjacent to the shoulders of a user and having a slot through which the head of said user can extend.

6. An inflatable sleeping bag as in claim 2 wherein said sleeping bag further comprises an inner absorbent liner.

7. An inflatable sleeping bag as in claim 2 wherein said valve of the upper portion is located in the upper surface of said upper portion in a position convenient to a user to adjust the inflation without moving his body.

8. A mat as defined in claim 2, wherein said impermeable material is made from plasticized material selected from the group essentially consisting of urethane coated nylon fabric and plastic coated cotton fabric.

9. A mat having layers of impermeable material adapted to inflation as an air-mattress, inflatable blanket or component of a sleeping bag, and containing an insulating amount of a tangle of lofting shredded resilient plastic web formed of plastic film, said web having at least sections thereof in elongated strip form, oriented randomly in nonplanar configurations, and having a valve means for inflation and deflation of the mat.

10. A mat as in claim 9 comprising a plurality of strips of resilient plastic film oriented randomly in non-planar configurations.

11. A mat as in claim 9, incorporated into an inflatable sleeping bag, said bag having an inflatable upper portion and an inflatable lower portion, means for inflating the lower portion of the said bag separately from the upper portion, the portions of the said bag being closeable with a fastening means, each of the portions being provided with an insulating amount of the lofting shredded plastic web.

12. A mat as in claim 9, wherein said film is made of Mylar, polyvinyl chloride or polyurethane.

13. An inflatable sleeping bag capable of providing selectively adjustable insulating properties, comprising first and second layers of impermeable material joined at the peripheral edges thereof to form a first mat containing an insulating amount of a lofting shredded resilient plastic web formed of strips of plastic film metalized on at least one surface thereof, and first valve means for effecting inflation of said first mat; and third and fourth layers of impermeable material joined at the peripheral edges thereof to form a second mat containing an insulating amount of a lofting shredded resilient plastic web formed of strips of plastic film metalized on at least one surface thereof, and second valve means for effecting inflation of said first mat;

said first and second mats being superimposed and joined along at least a portion of the peripheral edges thereof to provide a sleeping compartment therebetween, the insulating properties of which may be adjusted by adjusting the degree of inflation of at least one of said first and second mats.

14. An inflatable sleeping bag as defined in claim 13, wherein the lofting provided in each mat is formed of strips oriented randomly in non-planar configurations.

15. An inflatable sleeping bag as defined in claim 14, wherein portions of the peripheral edges of said first and second mats are permanently secured together and other portions are removably fastened by fastening means.

16. A heat insulating material as defined in claim 13, wherein said film is metallized with aluminum.

17. A heat insulating material as defined in claim 16, wherein said film is made of a material selected from the group essentially consisting of Mylar, polyvinyl chloride and polyurethane.

18. In inflatable sleeping bag as defined in claim 13, wherein said sleeping bag comprises a web secured with the upper portion adjacent to the shoulders of a user and having a slot through which the head of said user can extend.

19. An inflatable sleeping bag as defined in claim 13, wherein said sleeping bag further comprises an inner absorbent liner.

20. A mat as defined in claim 13, wherein said impermeable material is made from plasticized material selected from the group essentially consisting of urethane coated nylon fabric and plastic coated cotton fabric.

* * * * *